US011478847B2

(12) United States Patent
Dudas et al.

(10) Patent No.: US 11,478,847 B2
(45) Date of Patent: Oct. 25, 2022

(54) METHOD FOR PRODUCING A COOLING DEVICE

(71) Applicant: Robert Bosch GmbH, Stuttgart (DE)

(72) Inventors: Zsolt Dudas, Ditzingen (DE); Juergen Steinbach, Freiberg (DE); Martin Roettgen, Stuttgart (DE); Silvan Hippchen, Sersheim (DE); Daniel Engelhardt, Kassel (DE); Robert Schenk, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 52 days.

(21) Appl. No.: 16/482,459

(22) PCT Filed: Jan. 11, 2018

(86) PCT No.: PCT/EP2018/050624
§ 371 (c)(1),
(2) Date: Jul. 31, 2019

(87) PCT Pub. No.: WO2018/141521
PCT Pub. Date: Aug. 9, 2018

(65) Prior Publication Data

US 2020/0001356 A1 Jan. 2, 2020

(30) Foreign Application Priority Data

Feb. 1, 2017 (DE) ..... 10 2017 201 583.7

(51) Int. Cl.
*B22D 17/20* (2006.01)
*B22D 19/00* (2006.01)
(Continued)

(52) U.S. Cl.
CPC ..... *B22D 17/20* (2013.01); *B22D 19/0072* (2013.01); *B22D 19/0081* (2013.01);
(Continued)

(58) Field of Classification Search
CPC ..... B22D 17/20; B22D 19/0072; B22D 19/0081; B22D 21/007; B22D 23/04;
(Continued)

(56) References Cited

U.S. PATENT DOCUMENTS

2007/0154729 A1* 7/2007 Chastain ..... A61L 31/088 428/607
2015/0151385 A1* 6/2015 Oda ..... B23K 35/002 428/639

FOREIGN PATENT DOCUMENTS

CN 106670257 A * 5/2017
DE 1119469 12/1961
(Continued)

OTHER PUBLICATIONS

English Machine Translation of Barth (Year: 2009).*
(Continued)

*Primary Examiner* — Kevin P Kerns
(74) *Attorney, Agent, or Firm* — Michael Best & Friedrich LLP

(57) ABSTRACT

The invention relates to a method for producing a cooling device (10), which has at least one hollow body (30) made of a first material having good thermal conduction and a base body made of a second material having good thermal conduction, and a pre-product for the production of a cooling device (10) and a cooling device (10) for an electrical assembly and an electrical assembly having a cooling device of this kind. The hollow body (30) is coated on the outside with a third material and is filled on the inside with the third material, which has a lower melting temperature than the first material and the second material, wherein the filling (5) completely fills the hollow body and is then cooled, wherein the filled hollow body (30) is placed in a die-casting mould, wherein the second material is introduced into the die-casting mould as die casting with a first
(Continued)

temperature and flows around the hollow body (30) at least partially, wherein the die casting melts off the third material of the surface coating (36) and melts on the first material of the hollow body (30) so that at least in regions an integral connection is formed between the die casting of the second material, which forms the base body (20), and the first material of the hollow body (30), wherein the die casting of the second material becomes rigid and solid, wherein during the solidification phase, the die casting of the second material heats the filling (5) made of the third material in the interior of the hollow body (30) until the melting temperature is reached, and wherein the melted third material is removed from the hollow body (30) under pressure.

7 Claims, 3 Drawing Sheets

(51) Int. Cl.

| | |
|---|---|
| ***B22D 21/00*** | (2006.01) |
| ***B22D 23/04*** | (2006.01) |
| ***B22D 23/06*** | (2006.01) |
| ***F28D 1/047*** | (2006.01) |
| ***F28F 3/12*** | (2006.01) |
| ***F28F 21/08*** | (2006.01) |
| *F28D 21/00* | (2006.01) |

(52) U.S. Cl.
CPC ..... *B22D 21/007* (2013.01); *B22D 23/04* (2013.01); *B22D 23/06* (2013.01); *F28D 1/0477* (2013.01); *F28F 3/12* (2013.01); *F28F 21/084* (2013.01); *F28F 21/085* (2013.01); *F28D 2021/0029* (2013.01); *F28F 2255/146* (2013.01)

(58) Field of Classification Search
CPC ..... B22D 23/06; B22D 17/00; B22D 19/00; B22D 21/00
USPC ..... 164/98, 332
See application file for complete search history.

(56) References Cited

FOREIGN PATENT DOCUMENTS

| | | | | |
|---|---|---|---|---|
| DE | 102008039208 | | 2/2009 | |
| DE | 102008016994 | | 10/2009 | |
| DE | 102011076312 | | 11/2012 | |
| DE | 102015001190 | | 8/2016 | |
| JP | 62087796 A | * | 4/1987 | |
| JP | 10152767 A | * | 6/1998 | ..... F28F 1/022 |

OTHER PUBLICATIONS

English Machine Translation of Fujiyoshi JP 10152767 A (Year: 1998).*
English Machine Translation of CN 106670257 A (Year: 2017).*
English Machine Translation of JP 62087796 A (Year: 1987).*
International Search Report for Application No. PCT/EP2018/050624 dated Apr. 6, 2018 (English Translation, 3 pages).
Yoon et al., "Fabrication of automotive heat exchanger using kinetic spraying process," Surface and Coatings Technology, Elsevier BV, Amsterdam, NL, Issue 201, No. 24, Aug. 30, 2007, pp. 9524-9532.

* cited by examiner

METHOD FOR PRODUCING A COOLING DEVICE

BACKGROUND OF THE INVENTION

The invention is based on a method for producing a cooling apparatus. The subject of the present invention is also a precursor for producing a cooling apparatus, a cooling apparatus for an electrical assembly and an electrical assembly having such a cooling apparatus.

From the prior art, the casting of pipe inserts is generally a customary method for motor vehicle assemblies too, such as for example a cooling coil into a die casting cooler, an oil line into a gearbox, etc. In particular when producing aluminum die-cast parts into which aluminum pipes are inserted, the robustness of the aluminum pipe inserts should be maintained during the casting process. The high melting temperature and the pressure of the aluminum die casting melt can be particularly critical for the aluminum pipe inserts. Therefore, it is known practice from the prior art to fill the aluminum pipe inserts with a salt core or sand core in order to ensure pipe robustness during the casting process. After the insert has been cast, the salt core filling or sand core filling is removed by means of an additional rinsing process in order to ensure the continuity of the pipe.

DE 10 2008 039 208 A1 discloses the production of aluminum die-cast subassemblies having cores, which are supposed to form a cavity in the aluminum subassembly and have a surface layer made of a metal or a metal alloy, in particular copper, nickel, zinc, tin, bismuth, silicon, copper/tin base alloy, copper/nickel base alloy, copper/zinc base alloy, which remain in the cast part after the casting process for economic reasons. The surface coating acts as a bonding layer between melt and core jacket and influences the functionality of the core jacket part remaining in the cast part in a deliberate manner, in particular in respect of the thermal conductivity between the casting wall of the finished subassembly and the coolant-filled later cavity of the cast part.

DE 10 2011 076 312 A1 discloses a cooling apparatus for a housing holding at least one module of power electronics. A hollow cooling structure to be encapsulated is a cooling area for the housing. The cooling structure to be encapsulated is supported during manufacture of the housing by a medium applied to the cooling structure to be encapsulated. In this case, the cooling structure to be encapsulated is manufactured from aluminum or an aluminum alloy and extends meanderously or in a U-shape from an inflow of the medium to an outflow of the medium.

SUMMARY OF THE INVENTION

The method for producing a cooling apparatus according to the inventionhas the advantage that the coating and filling of the at least one hollow body is combined in a process and no additional transport is required. Instead of an additional rinsing process, the filling made of the third material is removed quickly and inexpensively in an advantageous manner in the hot and liquid state directly after casting, owing to the material properties. Since the coating material is simultaneously used for filling the hollow body, the number of materials in the assembly can be reduced, since no additional filling material, such as for example salt or sand, is required in order to ensure the robustness of the hollow body during the casting process. Also, the surface coating made of the third material protects the surface of the hollow body against oxidation before the hollow body is processed further. The surface coating is advantageously melted away on account of the high temperature of the die casting of the second material, which is higher than the melting temperature of the third material, and rinsed away from the first material of the hollow body, so that a material bond between the first material of the hollow body and the second material of the die casting or of the base body is rendered possible at least in regions.

Embodiments of the present invention provide a method for producing a cooling apparatus comprising at least one hollow body made of a first material having good thermal conductivity and a base body made of a second material having good thermal conductivity. In this case, the outside of the hollow body is coated with a third material and the inside of the hollow body is filled with the third material, which has a lower melting temperature than the first and second materials. The filling fills the hollow body and is subsequently cooled. The filled hollow body is put into a die casting mold. Subsequently, the second material is introduced as a die casting at a first temperature into the die casting mold and flows around the hollow body at least in part, wherein the die casting melts away the third material of the surface coating and melts onto the first material of the hollow body, so that a material bond between the die casting of the second material, forming the base body, and the first material of the hollow body is obtained at least in regions. Subsequently, the die casting of the second material sets and becomes solid, wherein during the setting phase the die casting of the second material heats the filling made of the third material inside the hollow body until it reaches the melting temperature, and wherein the molten third material is removed from the hollow body under pressure.

Also, a precursor for producing a cooling apparatus is proposed. The precursor comprises a tubular hollow body made of a first material having good thermal conductivity. In this case, the unbent hollow body has a surface coating on its outside and a filling made of a third material having good thermal conductivity, which has a lower melting point than the first material. The filling fills the hollow body completely. The handling of an unbent hollow body during coating and filling is simpler than in the case of an already bent hollow body.

Also, embodiments of the present invention provide a cooling apparatus for an electrical assembly. Such a cooling apparatus comprises at least one hollow body made of a first material having good thermal conductivity that is embedded in a base body made of a second material having good thermal conductivity. In this case, a material bond is formed, at least in regions, between the first material of the at least one hollow body and the second material of the base body on the outside of the at least one hollow body. Also, the hollow body has a surface coating on its inside, made of a third material having good thermal conductivity that has a lower melting temperature than the first material of the hollow body having good thermal conductivity and the second material of the base body having good thermal conductivity. The material bond and integration of the hollow body in the base body allows a low thermal resistance to be implemented between the base body and the hollow body, so that it is advantageously possible to dispense with further measures, such as for example applying a thermally conductive adhesive, to improve the thermal conductivity between the base body and the hollow body. Also, the surface coating on the inside of the hollow body has the advantage that oxidation of the surface of the hollow body is prevented, so that good heat transfer between the hollow body and a cooling medium flowing through the hollow body is possible.

Such a cooling apparatus can be used in an electrical assembly for cooling at least one electrical power subassembly.

The measures and developments presented in the dependent claims allow advantageous improvements of the method and apparatus of the independent claims.

It is particularly advantageous that the first material of the hollow body can be aluminum or an aluminum alloy. The second material of the base body can likewise be aluminum or an aluminum alloy. The use of aluminum or of an aluminum alloy allows the lightweight design concept and good thermal conductivity to be implemented inexpensively and easily, since it is possible to resort to proven methods and processes during production. The third material of the surface coating of the hollow body can be for example zinc or a zinc alloy or tin or a tin alloy. The tin or zinc materials have distinctly higher thermal conductivity values than salt or sand, i.e. they support the hollow body during the casting process not only mechanically but also thermally. Also, the low melting temperatures of tin (231° C.) and zinc (419° C.) allow easy and fast coating and filling of the hollow body made of aluminum, which has a substantially higher melting temperature (660° C.), wherein a maximum temperature of the viscous aluminum die casting has a value in the range from approximately 560 to 580° C. Different alloys could be used to reduce the melting point of the surface coating even further, in order to assist the melting away of the surface coating of the hollow body by the aluminum die casting. During casting, the tin or zinc material of the filling in the hollow body is still solid, i.e. the hollow body remains robust. After a very short time (approximately 1 sec), the die casting sets and becomes solid. In parallel, the tin or zinc material in the hollow body is heated and reaches or exceeds its melting point. From this moment, the molten tin or zinc material can be removed from the hollow body at high pressure, for example by means of a gas injection. The tin or zinc material removed from the hollow body can be collected and reused (recycling).

In an advantageous configuration of the method, the hollow body can be treated using a zincate method before coating and filling. As a result, in particular when aluminum is used as the first material, it is possible for an oxide layer on the hollow body surface to be removed before the surface of the hollow body is protected against renewed oxidation by means of a surface coating, preferably made of a tin or zinc material.

In a further advantageous configuration of the method, the hollow body can be coated and filled with the third material in a coating bath. Such a coating bath allows the coating and filling of the hollow body with the third material to be performed in one process step. Also, the filling of the hollow body with the molten liquid third material is performable more quickly and inexpensively than filling with salt or sand.

In a further advantageous configuration of the method, the filled and cooled hollow body can be cut and bent into a desired shape. It is substantially easier to bend and cut a precursor comprising a filled and coated hollow body than to bend and cut the hollow body first and then to coat and fill it.

In a further advantageous configuration of the method, during the setting phase the temperature of the filling can be ascertained at the ends of the hollow body. As such, the pressure for removing the filling can be applied to the hollow body when the temperature of the filling reaches and/or exceeds a prescribed threshold value. The prescribed temperature threshold value can be chosen in this case such that the third material of the filling has exceeded its melting point and is liquid. In order to detect this time window in optimum fashion and independently of the product, there can be provision made for temperature sensors at the ends of the hollow body. The pressure for blowing out the hollow body can then be controlled by the measured values of the temperature sensors.

In an advantageous configuration of the precursor, the coated and filled tubular hollow body can be bent and cut into a desired shape directly after cooling.

In an advantageous configuration of the electrical assembly, the cooling apparatus can be used for example as a baseplate of the electrical assembly and/or as part of a housing of the electrical assembly. The power subassemblies to be cooled can then be arranged on this baseplate or the housing part. In this case, the cooling apparatus can be used as a gas cooler, in the case of which a gas is routed through the hollow body to remove heat, or as a liquid cooler, in the case of which a liquid is routed through the hollow body to remove heat.

Exemplary embodiments of the invention are depicted in the drawing and are explained in more detail in the description that follows. In the drawing, identical reference signs denote components and elements that carry out identical or analogous functions.

DETAILED DESCRIPTION

Figure 1:
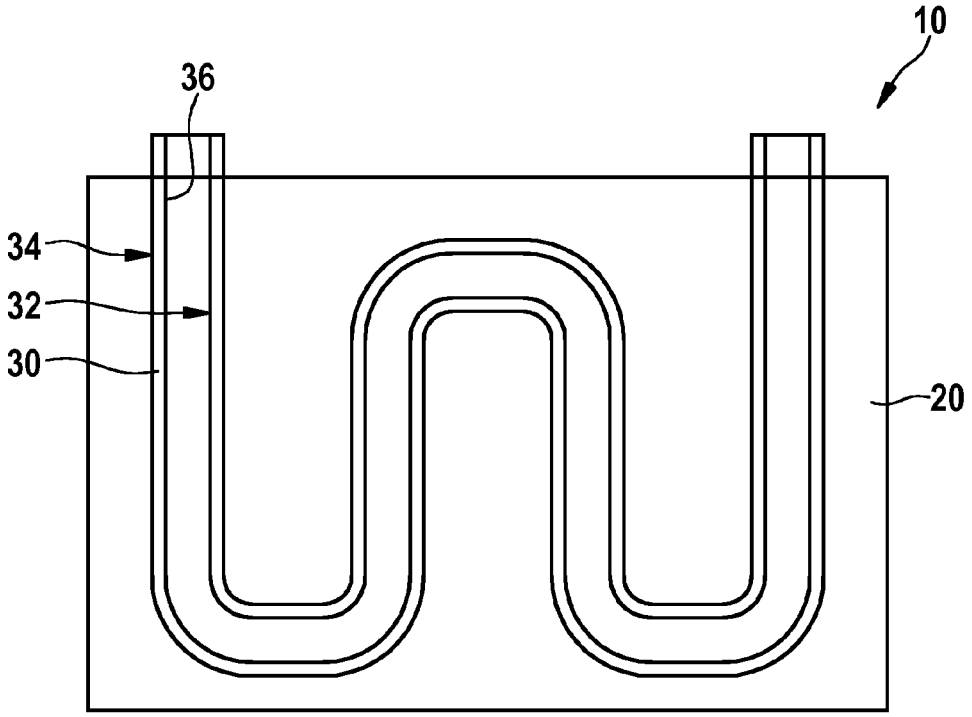
FIG. 1 shows a longitudinal sectional depiction of an exemplary embodiment of a cooling apparatus according to the invention for an electrical assembly.
Figure 2:
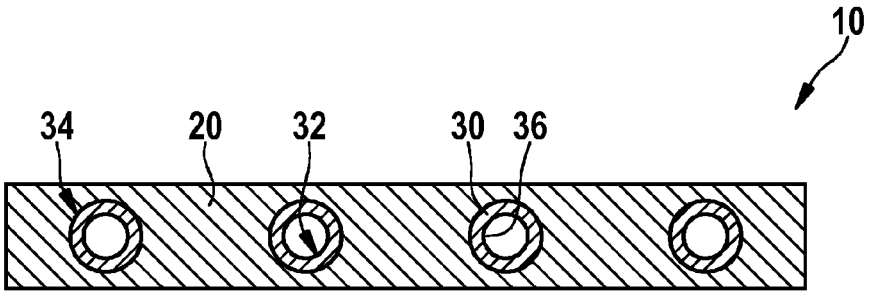
FIG. 2 shows a cross sectional depiction of the exemplary embodiment of a cooling apparatus according to the invention for an electrical assembly from FIG. 1.

As can be seen from FIGS. 1 and 2, the depicted exemplary embodiment of a cooling apparatus 10 for an electrical assembly has at least one hollow body 30 made of a first material having good thermal conductivity, which is embedded in a base body 20 made of a second material having good thermal conductivity. In this case, a material bond is formed, at least in regions, between the first material of the at least one hollow body 30 and the second material of the base body 20 on the outside 34 of the at least one hollow body 30. Also, the hollow body 30 has a surface coating 36 on its inside 32, made of a third material having good thermal conductivity, which has a lower melting temperature than the first material of the hollow body 30 having good thermal conductivity and the second material of the base body 20 having good thermal conductivity.

In the depicted exemplary embodiment of the cooling apparatus 10, the first material of the hollow body 30 is a wrought aluminum alloy and the second material of the base body 20 is an aluminum die casting. The third material of the surface coating 36 of the hollow body 30 is zinc in the depicted exemplary embodiment. It goes without saying that other material combinations are also conceivable, for example the hollow body 30 can also be manufactured from copper or a copper alloy or another suitable metal having good thermal conductivity or a metal alloy, for example. The surface coating 36 of the hollow body 30 can also be a zinc alloy or tin or a tin alloy, for example. In the depicted exemplary embodiment, the hollow body 30 is in the form of a meanderously bent pipe having a round cross section. It goes without saying that the hollow body 30 can also have other shapes and cross sections and be embodied as a pipe bent in a U-shape having a square cross section, for example.

Preferably, exemplary embodiments of the cooling apparatus 10 according to the invention for cooling at least one electrical power subassembly are used in an electrical assembly, not depicted in more detail, embodied as a control unit, for example. As such, the cooling apparatus 10 can be used as a baseplate of the electrical assembly and/or as part of a housing of the control unit, for example. This baseplate or the housing part can then have the power subassemblies to be cooled arranged on it. In this case, the cooling apparatus 10 can be used as a gas cooler, in the case of which a gas is routed through the hollow body 30 to remove heat, or as a liquid cooler, in the case of which a liquid is routed through the hollow body 30 to remove heat.

Figure 3:
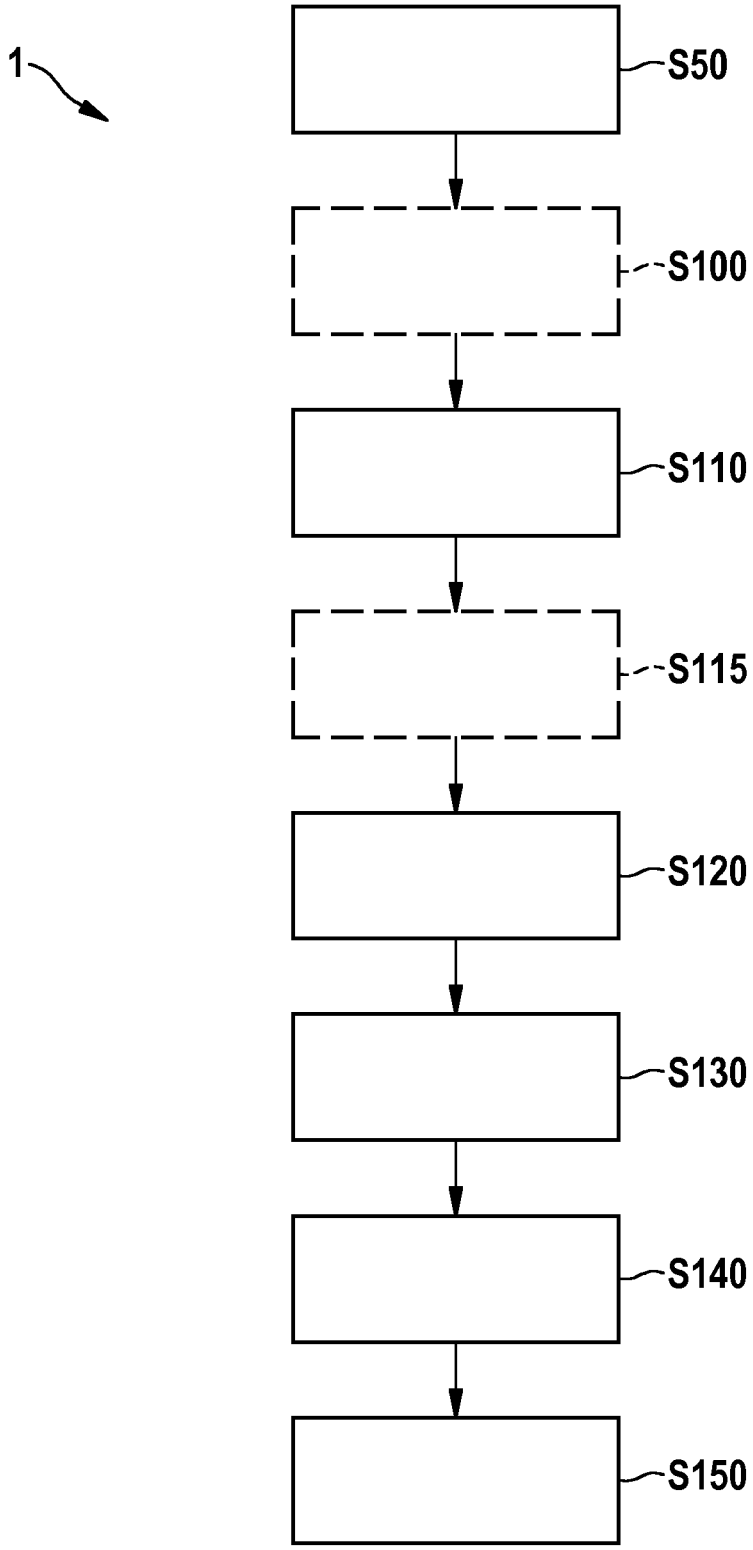
FIG. 3 shows a schematic flow chart for an exemplary embodiment of a method according to the invention for producing a cooling apparatus.
Figure 4:
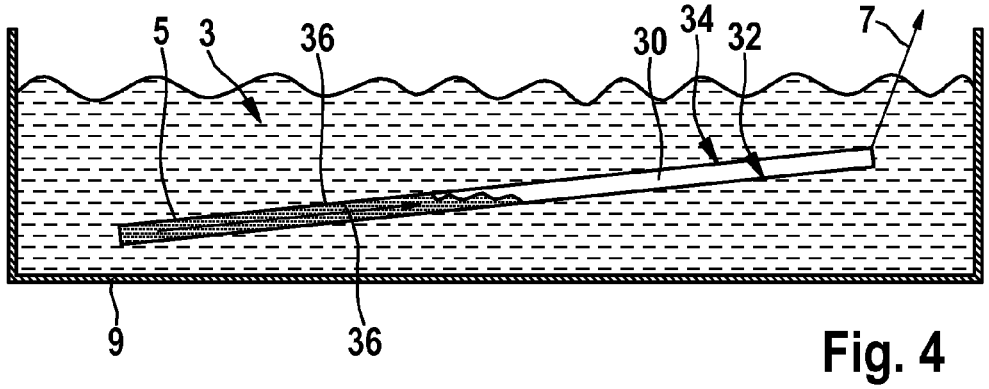
FIG. 4 shows a schematic depiction of a coating bath with an exemplary embodiment of a precursor according to the invention for producing a cooling apparatus.

As can be seen from FIGS. 3 and 4, the depicted exemplary embodiment of a method 1 according to the invention for producing a cooling apparatus 10 comprising at least one hollow body 30 made of a first material having good thermal conductivity and a base body 20 made of a second material having good thermal conductivity comprises the following steps:

In a step S100, the outside of the hollow body 30 is coated with a third material and the inside of said hollow body is filled with the third material, which has a lower melting temperature than the first material of the hollow body 30 and the second material of the base body 20. The filling 5 fills the hollow body 30. Subsequently, the filled hollow body is cooled in step S110 and the filled hollow body 30 is put into a die casting mold in step S120. In a step S130, the second material is put into the die casting mold as a die casting at a first temperature and flows around the hollow body 30 at least in part. In this case, the die casting melts away the third material of the surface coating 36 and onto the first material of the hollow body 30, so that a material bond between the die casting of the second material, forming the base body 20, and the first material of the hollow body 30 is obtained at least in regions. In step S140, the die casting of the second material sets and becomes solid, wherein the die casting of the second material heats the filling 5 made of the third material inside the hollow body 30 during the setting phase in step S140 until it reaches the melting temperature. In step S150, the molten third material is removed from the hollow body 30 under pressure.

In the depicted exemplary embodiment of the method 1 according to the invention, the first material used for the hollow body 30 and the second material used for the base body 20 is aluminum or an aluminum alloy. The third material used for the surface coating 36 and filling 5 of the hollow body 30 is zinc or a zinc alloy. It goes without saying that other material combinations are also conceivable, for example the hollow body 30 can also be manufactured from copper or a copper alloy or another suitable metal having good thermal conductivity or a metal alloy. The surface coating 36 of the hollow body 30 can also be tin or a tin alloy, for example.

As can also be seen from FIG. 3, the hollow body 30 can be treated using a zincate method in an optional step S50, depicted in dashes, before the coating and filling, in order to remove an oxide layer on the surface of the hollow body 30.

As can also be seen from FIG. 4, the hollow bodies 30 as a precursor 3 in unbent form having a length of approximately 6 m are coated and completely filled with the third material in a coating bath 9 in step S100 after the zincate method in step S50. As can be seen from FIG. 4, the hollow body 30 is dipped into the coating bath 9 at an angle and maintains this position during coating and filling, so that the hollow body 30 can be filled with the third material, in this case zinc, completely and air 7 can escape from the hollow body 30. When lifting the hollow body 30 out of the coating bath 9, the end of the hollow body 30 situated at the bottom is closed to produce a seal. In this state, the hollow body 30 is cooled, so that the third material in the still liquid state cannot flow out.

As can also be seen from FIG. 3, the filled and cooled hollow body 30 or the precursor 3 can be bent and cut into a desired shape in an optional step S115, depicted in dashes. The filling 5 increases the robustness of the hollow body 30 during the bending process or the mechanical working already.

In order to detect an optimum time window for removing the filling 5 from the hollow body 30, the temperature of the filling 5 can be ascertained at the ends of the hollow body 30 during the setting phase in step S140. In step S150, the pressure for removing the filling 5 can then be applied to the hollow body 30 when the temperature of the filling 5 reaches and/or exceeds a prescribed threshold value. The prescribed temperature threshold value can be chosen in this case such that the third material of the filling 5 has exceeded its melting point and is liquid. In order to detect this time window in optimum fashion and independently of the product, there can be provision made for temperature sensors at the ends of the hollow body 30. The pressure for blowing out the hollow body 30 can then be controlled by the measured values of the temperature sensors. If the hollow body 30 has a zinc filling, the pressure could be activated at a temperature of over 450° C. for the filling 5, for example. The pressure could be deactivated again when the temperature falls below 420° C. If the hollow body 30 has a tin filling 5, the pressure could be activated at a temperature of above 250° C. for the filling 5, for example. The pressure could be deactivated again when the temperature falls below 235° C. During this process, the pressure loss can be measured and hence the continuity of the hollow body 30 can also be monitored or checked. As such, it can become necessary to provide for temperature sensors at the position of the ends of the hollow body 30, for example. The third material of the filling 5 that is removed from the hollow body 30 can be collected and reused (recycling).

Figure 5:
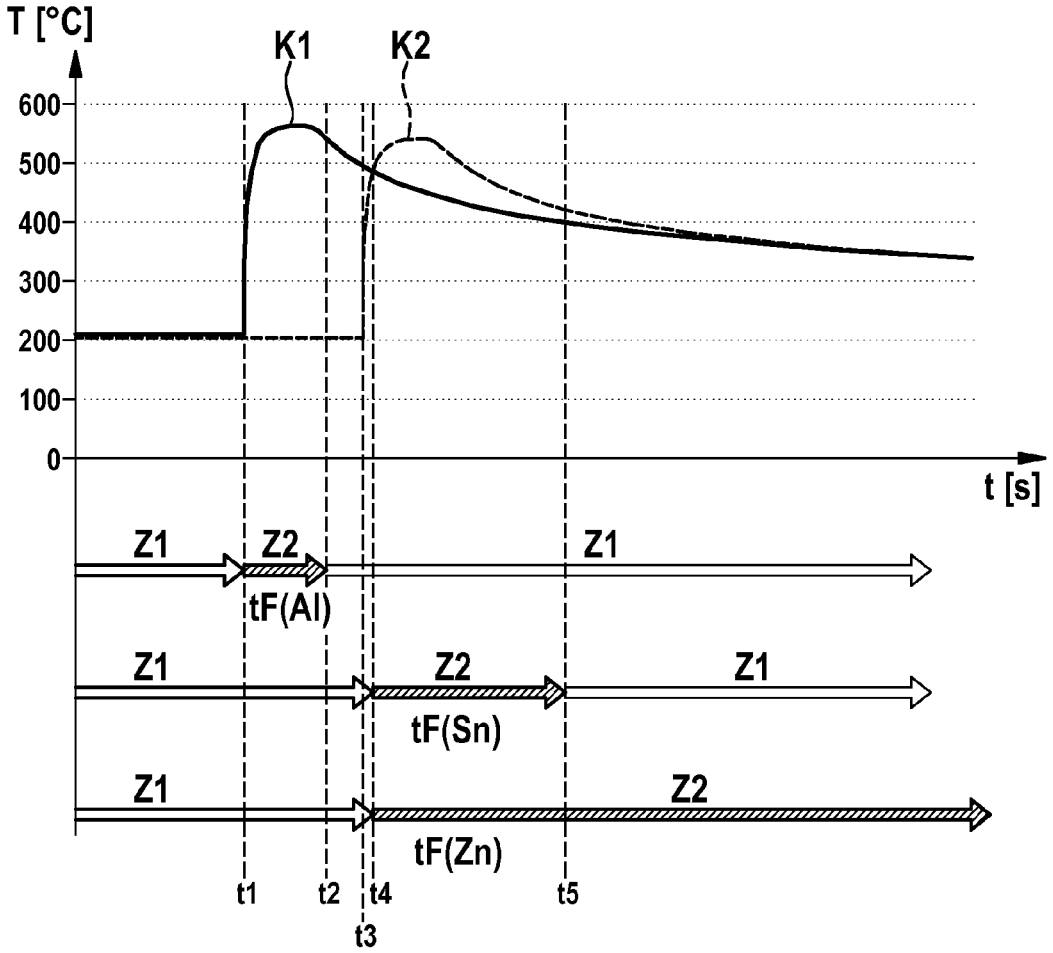
FIG. 5 shows a graph of characteristic curves that depicts a first characteristic curve having the temperature characteristic of a die casting and a second characteristic curve having the temperature characteristic of a filling of a hollow body during the production of a cooling apparatus according to the invention for an electrical assembly.

As can be seen from FIG. 5, the aluminum used in the depicted exemplary embodiment, which is introduced as a die casting into the die casting mold in step S130 and the temperature characteristic of which shows a first characteristic curve K1, has a solid first state Z1 up to the time t1. During a first time window tF(Al) between the time t1 and a second time t2, the aluminum die casting introduced has a liquid or viscous state Z2 and a temperature in the range from 400 to 580° C. From the time t2 onward, the aluminum die casting sets and has the solid first state Z1 again. As the first characteristic curve K1 shows, the aluminum die casting cools slowly.

As can also be seen from FIG. 5, the filling 5 of the hollow body 30, the temperature characteristic of which shows a second characteristic curve K2, still has the solid first state Z1 during casting, i.e. the hollow body 30 remains robust. After the first time window tF(Al), which is very short (approximately 1 second), the die casting sets and becomes solid. In parallel, the filling 5 in the hollow body 30 is heated by the hot die casting, and the melting temperature of the filling 5 is reached or exceeded. When tin is used, the filling 5 reaches its melting temperature at a third time t3 and changes to the liquid or viscous state Z2 for the duration of a second time window tF(Zn). When zinc is used, the filling 5 reaches its melting temperature at a fourth time t4 and changes to the liquid or viscous state Z2 for the duration of a third time window tF(Sn). From a fifth time t5 onward, the filling 5 sets again and has the solid first state Z1 again. Therefore, the molten filling 5 can be removed from the hollow body 30 at high pressure during the second time window tF(Zn) when tin is used. When zinc is used, the molten filling 5 can be removed from the hollow body 30 at high pressure during the third time window tF(Sn), the third time window tF(Sn) being substantially shorter than the second time window tF(Zn), the end of which and the transition to the solid first state no longer being visible on account of the scaling of the graph.

The invention claimed is:

1. A method (1) for producing a cooling apparatus (10) comprising at least one hollow body (30) made of a first material being thermally conductive and a base body (20) made of a second material being thermally conductive, the method comprising coating an outside of the at least one hollow body (30) with a third material to provide a surface coating (36) of the third material, filling an inside of the at least one hollow body with the third material to provide a filled at least one hollow body (30) with a filling (5) of the third material, which has a lower melting temperature than the first and second materials, subsequently cooling the filling (5), subsequently putting the filled at least one hollow body (30) into a die casting mold, subsequently introducing the second material as a die casting at a first temperature into the die casting mold, wherein the second material flows around the at least one hollow body (30) at least in part, and wherein the die casting melts away the third material of the surface coating (36) and melts onto the first material of the at least one hollow body (30), so that a material bond between the die casting of the second material, forming the base body (20), and the first material of the at least one hollow body (30) is obtained at least in regions, wherein the die casting of the second material sets and becomes solid during a setting phase, wherein during the setting phase the die casting of the second material heats the filling (5) made of the third material inside the at least one hollow body (30) until the filling (5) reaches the melting temperature of the third material and becomes molten third material, and removing the molten third material from the at least one hollow body (30) under pressure.

2. The method (1) as claimed in claim 1, characterized in that the first material of the at least one hollow body (30) and/or the second material of the base body (20) is aluminum or an aluminum alloy and the third material of the surface coating (36) of the at least one hollow body (30) is zinc or a zinc alloy or tin or a tin alloy.

3. The method (1) as claimed in claim 1, characterized in that the at least one hollow body (30) is treated using a zincate method before coating and filling.

4. The method (1) as claimed in claim 1, characterized in that the at least one hollow body (30) is coated and filled with the third material in a coating bath (9).

5. The method (1) as claimed in claim 1, characterized in that the filled and cooled at least one hollow body (30) is bent and cut into a desired shape.

6. The method (1) as claimed in claim 1, characterized in that during the setting phase the temperature of the filling (5) is ascertained at ends of the at least one hollow body (30).

7. The method (1) as claimed in claim 6, characterized in that pressure to remove the filling (5) is applied to the at least one hollow body (30) when the temperature of the filling (5) reaches and/or exceeds a prescribed threshold value.

* * * * *